US009695577B2

(12) United States Patent
Leymann et al.

(10) Patent No.: US 9,695,577 B2
(45) Date of Patent: Jul. 4, 2017

(54) METHOD AND DEVICE FOR AUTOMATIC FLUSHING

(75) Inventors: Stefan Leymann, Attendorn (DE); Oliver Cyliax, Siegen (DE); Christian Becker, Plettenberg (DE); Stefan Schulte, Attendorn (DE)

(73) Assignee: Viega Technology GmbH & Co. KG, Attendorn (DE)

( * ) Notice: Subject to any disclaimer, the term of this patent is extended or adjusted under 35 U.S.C. 154(b) by 1196 days.

(21) Appl. No.: 13/414,990

(22) Filed: Mar. 8, 2012

(65) Prior Publication Data

US 2012/0234398 A1 Sep. 20, 2012

(30) Foreign Application Priority Data

Mar. 14, 2011 (DE) ..... 10 2011 013 955

(51) Int. Cl.

| | |
|---|---|
| ***B08B 9/032*** | (2006.01) |
| ***E03B 7/00*** | (2006.01) |
| ***E03B 7/08*** | (2006.01) |
| *F24D 17/00* | (2006.01) |

(52) U.S. Cl.

CPC ..... *E03B 7/006* (2013.01); *E03B 7/08* (2013.01); *B08B 9/0325* (2013.01); *F24D 17/0073* (2013.01); *Y10T 137/0424* (2015.04)

(58) Field of Classification Search

CPC ..... E03B 7/006; E03B 7/08; Y10T 137/0419; Y10T 137/0424; F24D 17/0073; B08B 9/0325

USPC ..... 137/15.04, 15.05

See application file for complete search history.

(56) References Cited

U.S. PATENT DOCUMENTS

| | | | | |
|---|---|---|---|---|
| 4,774,978 | A | 10/1988 | Lepine, Jr. et al. | |
| 5,025,754 | A | 6/1991 | Plyler | |
| 6,061,843 | A * | 5/2000 | Rump | E03C 1/057 4/302 |
| 2002/0157708 | A1 * | 10/2002 | Goff | E03B 7/006 137/238 |

(Continued)

FOREIGN PATENT DOCUMENTS

| | | | |
|---|---|---|---|
| DE | 202006016416 | U1 | 2/2007 |
| DE | 102006032048 | A1 | 1/2008 |

(Continued)

OTHER PUBLICATIONS

"Constant Definition—Google Search." Google. N.p., n.d. Web. Mar. 7, 2016. <https://www.google.com/search?q=constant&oq=constant&aqs=chrome.0.69i59j69i61j69i57j69i6013.791j0j7&sourceid=chrome&es_sm=0&ie=UTF-8>.*

*Primary Examiner* — Jonathan Bradford
(74) *Attorney, Agent, or Firm* — The Webb Law Firm

(57) ABSTRACT

The invention relates to a method for automatic flushing of fluid lines, in particular potable water lines. The invention further relates to a device for automatic flushing of fluid lines, in particular potable water lines. The invention is based on the technical problem to provide a method and a device for automatic flushing which allows a flushing behaviour that is better-suited to the circumstances and more reliable. The technical problem is solved by a method for automatic flushing of at least one fluid line, in particular a potable water line, in which a temperature profile of the fluid is measured, in which the measured data are evaluated and in which the automatic flushing of the at least one fluid line is influenced by an outcome of the evaluation.

16 Claims, 5 Drawing Sheets

(56) References Cited

U.S. PATENT DOCUMENTS

Figure 1:
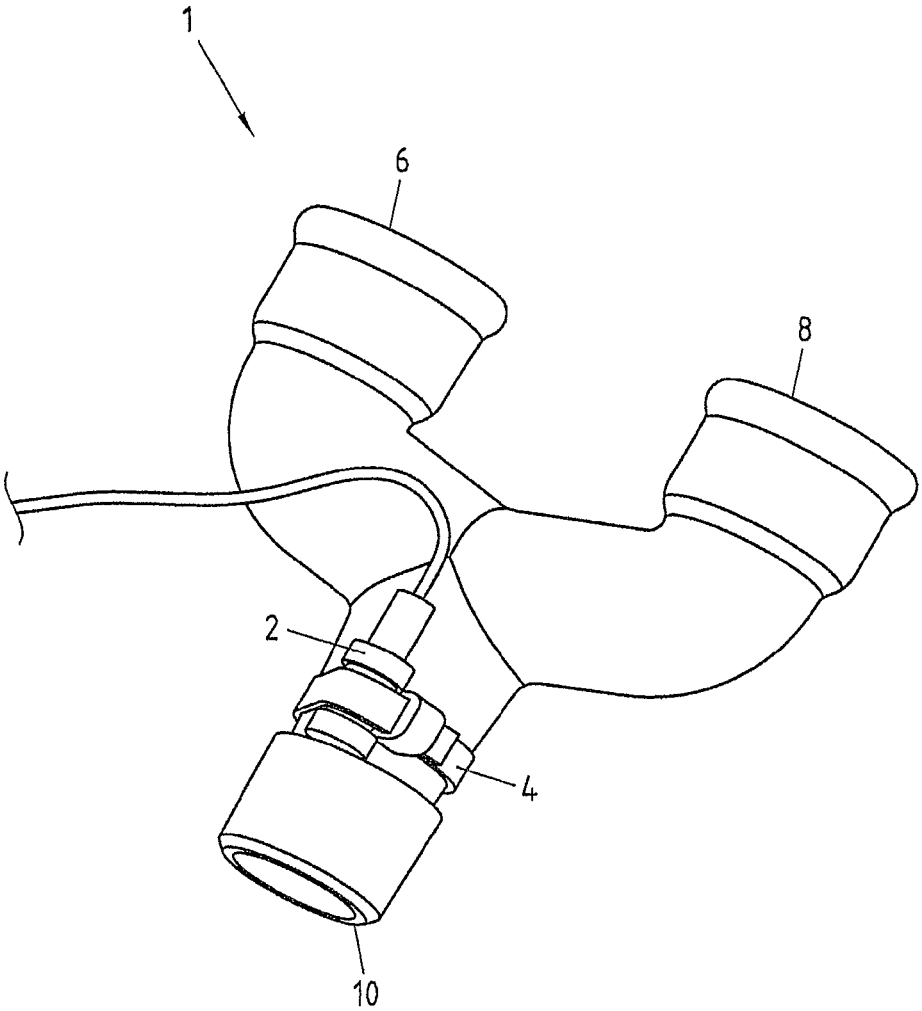

| | | | | |
|---|---|---|---|---|
| 2005/0103693 | A1 | 5/2005 | Palm et al. | |
| 2005/0274812 | A1 | 12/2005 | Taylor | |
| 2007/0119759 | A1 * | 5/2007 | Duplessis | C02F 1/008 210/85 |

FOREIGN PATENT DOCUMENTS

| | | | | |
|---|---|---|---|---|
| DE | 202008002822 | U1 | 8/2009 | |
| EP | 1964983 | B1 | 10/2010 | |
| GB | 2478124 | A | 8/2011 | |
| GB | 2502165 | A * | 11/2013 | E03B 7/08 |
| WO | 0161224 | A1 | 8/2001 | |
| WO | 2005124494 | A2 | 12/2005 | |

* cited by examiner

METHOD AND DEVICE FOR AUTOMATIC FLUSHING

The invention relates to a method for automatic flushing of fluid lines, in particular potable water lines. The invention further relates to a device for automatic flushing of fluid lines, in particular potable water lines.

Methods of the abovementioned kind are already known in the prior art. If fluid lines are not continuously used under certain circumstances deposits can form in the pipes through which the fluids pass, which can hinder the passage of the fluid or block parts of the pipe system. Furthermore, in particular in potable water lines, microorganisms such as bacteria, for example Pseudomonas or Legionella, can form constituting a risk to human health. Regular use of the water lines prevents such dangers. Regular use of the lines is often not possible, however. For example, hotel rooms may remain unoccupied or public buildings closed for extended periods. For these reasons methods have been developed to automatically trigger flushing of the lines.

So, for example, a method is known from patent specification EP 1964983 B1 which can bring about the flushing of a potable water line electronically via a central controller. But even with this method it still cannot be ensured that bacteria do not multiply in the potable water lines, however. So there is also a need to guarantee improved hygiene. The flushing frequency or duration can for example be increased, in order to guarantee improved hygiene. Repeated flushing, however, brings with it the disadvantage that the flushing may take place at times when this will disturb the occupants, for example while they are sleeping. The additional water consumption associated with more frequent flushing is also seen as a disadvantage.

On this basis, therefore, the invention is based on the technical problem to provide a method and a device for automatic flushing which allows a flushing behaviour that is better-suited to the circumstances and more reliable.

According to a first teaching of the invention the technical problem is solved by a method for automatic flushing of at least one fluid line, in particular a potable water line, in which a temperature profile of the fluid is measured, in which the measured data are evaluated and in which the automatic flushing of the at least one fluid line is influenced by an outcome of the evaluation.

According to the invention it has been identified that if a temperature profile of the fluid is measured, these measured data can be used in order to optimise the automatic flushing, thus the flushing behaviour. Since for example microorganisms are only viable within a certain temperature range, the possible presence of microorganisms can therefore be inferred or their occurrence virtually excluded on the basis of the temperature values. A usage profile of the line can also be inferred from these measured data. If for example a cold water line is used, the temperature changes since following cold water is generally colder than the water present in the line. Similarly when a hot water line is used, the temperature of the water changes since the following hot water is generally hotter than the water present in the line.

By evaluating the measured data the automatic flushing can thus be adapted on an individual basis.

The term temperature profile means temperature information as a function of time. Thus at least two temperature measured values at different times are necessary in order to measure a temperature profile.

The temperature measurement can be carried out either directly or indirectly. A direct measurement of the temperature of the fluid means that the temperature of the fluid itself can be measured, for example by temperature sensors that are in direct contact with the fluid. Preferably the temperature of the fluid is indirectly measured. The temperature of the system carrying the fluid can be measured, that is to say for example the pipes or the connection pieces. This can take place by sensors in contact with the pipe system. Contactless measurement is also conceivable, however. Thus in a simple manner the temperature of the fluid can be inferred.

It is possible to implement the method according to the invention in parallel with time- or volume-controlled flushing processes. For time-controlled flushing processes a flushing schedule can be programmed which stores the times at which flushing is preferably to take place. These times may also vary for different days of the week. These flushing processes can also be influenced by the method according to the invention.

The fluid line is preferably a potable water line for cold water or a potable water line for hot water. For such lines it is particularly important for example to be able to ensure a high level of purity of the water, since this can have a direct effect on human health.

The method according to the invention can also be carried out on a plurality of lines, wherein one or a plurality of lines can be a water line for cold potable water and one or a plurality of lines can be a water line for hot potable water. In this way the method according to the invention can be carried out on all lines to be flushed.

According to an advantageous embodiment of the method according to the invention a flushing process is triggered, ended, not triggered, inhibited or continued by an outcome of the evaluation. In this way the flushing behaviour can be influenced in a simple manner by the evaluation. This preferably takes place through electronic means that are able to measure the temperature profile, can perform the evaluation and can then control the flushing behaviour. This can take place by means of one or a plurality of valves. The valves can be opened in order to trigger a flushing process and left open in order to continue further with an existing flushing process. The valves can be closed in order to end a flushing process or remain closed in order to not trigger a flushing process in the first place or to inhibit a scheduled flushing process. In this way an interaction between statically planned flushing processes and the outcomes of the evaluation of the measured data can take place. Other elements are also conceivable, however, enabling the flushing of the fluid. The various consequences of the evaluation can all be implemented separately from one another in the method according to the invention.

A flushing process is substantially understood to be the process which allows a flowing of the fluid and then prohibits this. A flushing process can also have interruptions, however, or a plurality of flushing processes can also be combined into one.

It is advantageous if a flushing process is continued until a temperature threshold value and/or a temperature gradient value is exceeded or fallen below. Thus in a simple manner it can be ensured that sufficient flushing of the pipe system has taken place. Even if the water in the pipe system is completely replaced, it may be that nevertheless sufficient disinfection of the pipe system has not taken place. Since microorganisms are generally only viable within a certain temperature range, the flushing process can be continued until during the flushing process the temperature threshold at the limit of the range is exceeded or fallen below. In this way when flushing a hot water line it is possible for the flushing process to be ended for example only once a temperature of 60° C. has been measured. This temperature threshold can be specified as a set value, but it is also conceivable for the temperature threshold to be dependent upon other factors, such as for example the ambient temperature.

According to a further advantageous embodiment of the method according to the invention a flushing process is continued until for a specified length of time a substantially constant temperature is measured. By checking if for a specific length of time a substantially constant temperature is measured, the degree of disinfection and thus the hygiene of the pipe system can be further improved. Thus during a flushing process it is not only for a short length of time that a temperature threshold must be exceeded or fallen below, rather for a specified length of time a substantially constant temperature must be measured. In this way it can be ensured that the pipe system has been sufficiently flushed through and the fluid has had a sufficiently hot or cold temperature for a sufficient time. Preferably during the flushing of a hot water line a temperature of at least 60° C. is measured for a period.

It is similarly advantageous if a flushing process is triggered if for a specified length of time a substantially constant temperature is measured. If for a specified length of time a substantially constant temperature is measured, then no or little use can be inferred from this. In this case a flushing process can then be triggered. Thus in a simple manner it can be ensured that in the absence of use a flushing process is performed.

It is thus similarly advantageous if a flushing process is inhibited if for a specified length of time a substantially constant temperature is not measured. With sufficient use temperature variations occur in the pipe system. In this case a flushing process that may possibly have been scheduled can be dispensed with. As a result unnecessary flushing processes can be avoided and water can be saved.

According to a next advantageous embodiment of the method according to the invention a flushing process is triggered if for a specified length of time a sufficiently rapid change in temperature is not measured. In this way a gradient in the temperature profile can be included in the evaluation. Thus it can be determined even more reliably if use has been made of the pipe system. Thus naturally slow temperature variations can be differentiated from faster ones caused by use and a flushing process triggered as necessary. Accordingly also a flushing process can be inhibited if for a specified length of time a sufficiently rapid change in temperature is measured.

Now it is particularly advantageous if the temperature is measured by means of a temperature sensor on the pipeline. Thus in a simple and cost-effective manner a relatively accurate value can be determined for the temperature of the fluid which can be used for evaluation purposes. The measurement can take place directly and/or indirectly, for example in the medium itself and/or on the external wall of the pipeline.

The temperature measurement can be carried out at various positions or also at a plurality of positions of the installation. For this purpose it is advantageous if the temperature sensor is designed as a separate component which can be used flexibly at various positions of for example a ring line or serial line.

Furthermore, a temperature sensor designed as a separate component, for example an adapter piece, has the advantage that the temperature sensor can be built so that it comes into direct contact with the fluid. Such an adapter piece preferably has a threaded joint on either end so that it can be flexibly incorporated into a pipeline system.

For systems having plastic pipes such a separate element is also advantageous, since for temperature sensors affixed to the outer walls of plastic pipelines, the thermal conductivity of the plastic is insufficient to be able to measure temperatures with little or no time delay. Thus in this case direct temperature measurements are advantageous.

The temperature is preferably measured at or in a T-piece or at a U-piece of the pipeline. For this purpose a separate component can also be fitted. This can then already comprise the temperature sensor. In the case of a T-piece two arms of the T-piece can form the actual line, while the third arm of the T-piece serves for the flushing according to the invention of the line. If the temperature is measured at a T-piece, then both the normal use and a flushing process according to the invention will have their effects on the temperature profile. Thus the temperature measurement can also take place in the vicinity of or within a device according to the invention for automatic flushing of fluid lines.

According to a second teaching of the present invention, the technical problem is solved by a device for automatic flushing of fluid lines, in particular potable water lines. Regarding the advantages of the device according to the invention reference is made to the description of the method according to the invention. The device is suitable for in particular performing a method according to the invention. The device has means for measuring the temperature, means for capturing, storing and evaluating the measured temperatures and means for performing a flushing process. Various means for measuring the temperature and for capturing, storing and evaluating the temperatures are known from the prior art. Means for performing the flushing process are considered in particular to be a valve, for example a magnetic valve. A plurality of valves can also be provided, however. These can be opened and closed electronically. The device according to the invention can be operated in both serial and ring installations.

Optionally a shutoff device can by way of example also be provided, such as for example a ball valve, which is arranged in front of means for performing the flushing process. In this way the fluid line can be manually shut off for installation or maintenance purposes.

The device according to the invention preferably has a free outflow so that no direct contact occurs between the pipe system to be flushed and the waste water system.

Furthermore, the device according to the invention preferably has two outlets, preferably in the form of siphons. In this way in a simple manner the fluid can flow rapidly into the waste water system and an odour trap can be created in respect of the waste water system. It is also conceivable, however, to provide just one outlet or more than two outlets.

A backflow sensor system can preferably also be provided. In this way it can be guaranteed that no water damage is caused by an automatic flushing. The backflow sensor system can preferably inhibit flushing processes in order to avoid damage from overflowing water. In addition a fault signal can be emitted which takes the form of an acoustic and/or optical and/or electrical signal to a building control system.

The abovementioned components are preferably mounted on a base frame which can be sealed by a cover.

The device can have means for flushing a single or also a plurality of fluid lines. Thus for example just a cold potable water line can be flushed or a cold potable water line and a hot potable water line. Even more lines can also be flushed just as well, however. The flushing of the individual lines can preferably be controlled separately from one another. This can take place in a common control module, however.

It is particularly advantageous if the device has a modular design of individual components, so that without adversely affecting the functioning of the device, individual components can be removed or added as necessary.

Particularly preferably a temperature sensor is provided on a pipeline. Thus in a simple and cost-effective manner a relatively accurate value for the temperature of the fluid can be inferred which can be used for the evaluation. The measurement can take place directly and/or indirectly, for example in the medium itself and/or on the external wall of the pipeline.

Means for measuring the temperature can preferably be provided on a T-piece or a U-piece. Here two arms of the T-piece can form the actual line, while the third arm of the T-piece serves for the flushing according to the invention of the line. If the temperature is measured at a T-piece, then both the normal use and a flushing process according to the invention will have their effects on the temperature profile. Thus the temperature measurement can also take place in the vicinity of or within a device according to the invention for automatic flushing of fluid lines.

Means for measuring the temperature in the form of a separate component are particularly advantageous for flexible positioning in the pipeline system.

Figure 2:
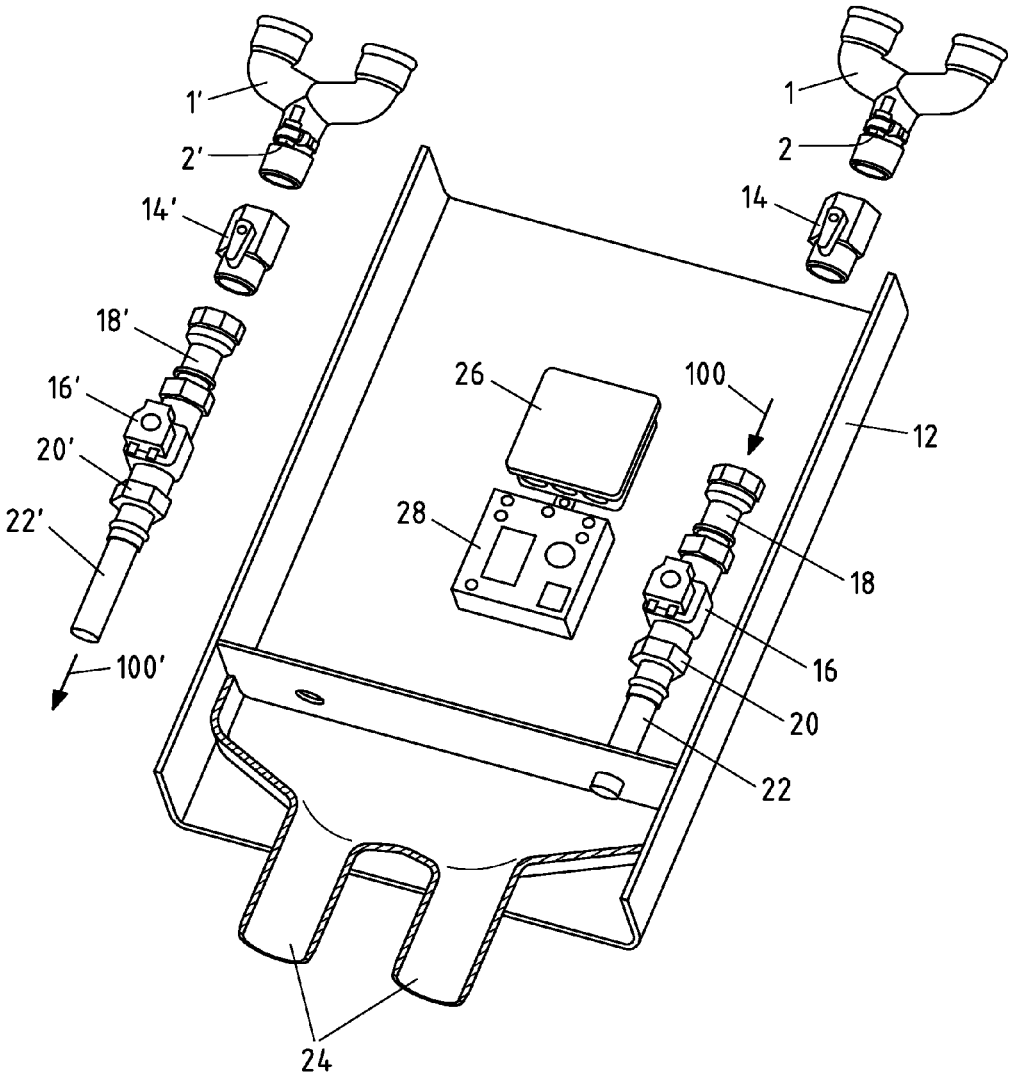
Figure 3:
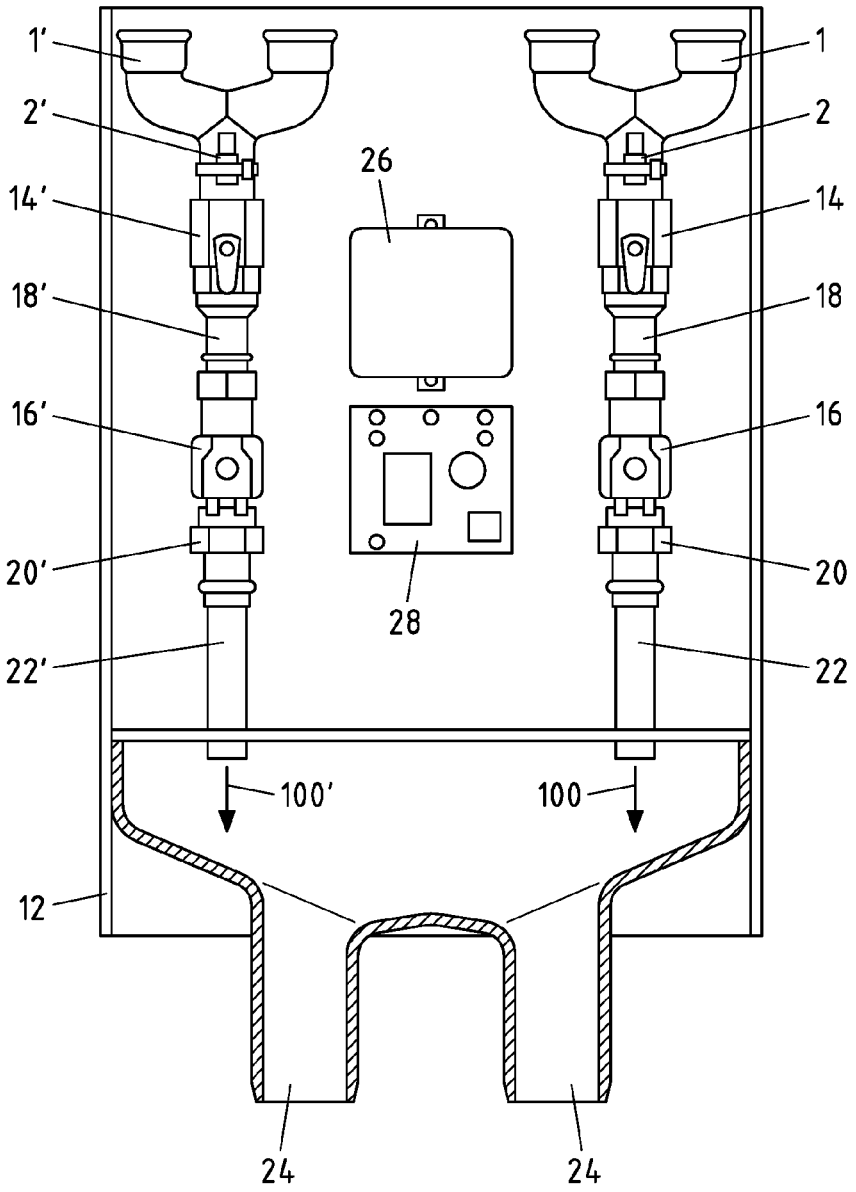
Figure 4:
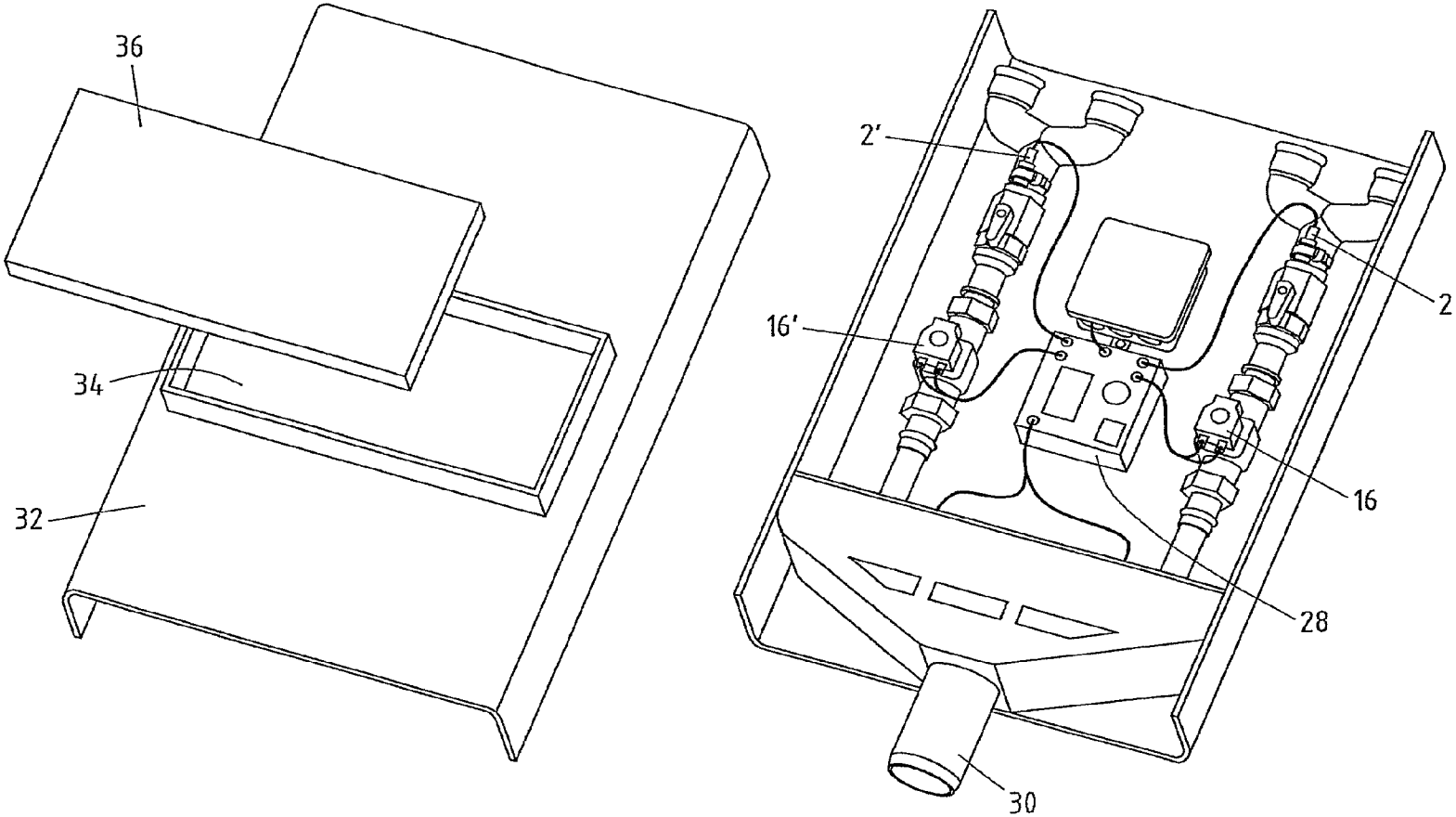
Figure 5:
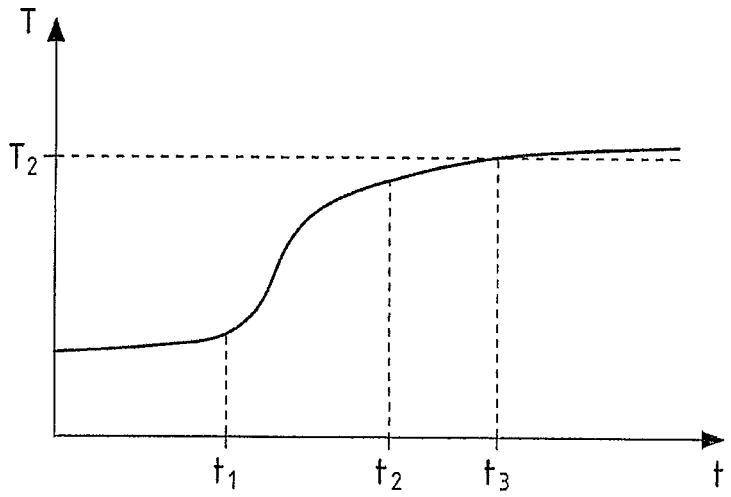
Figure 6:
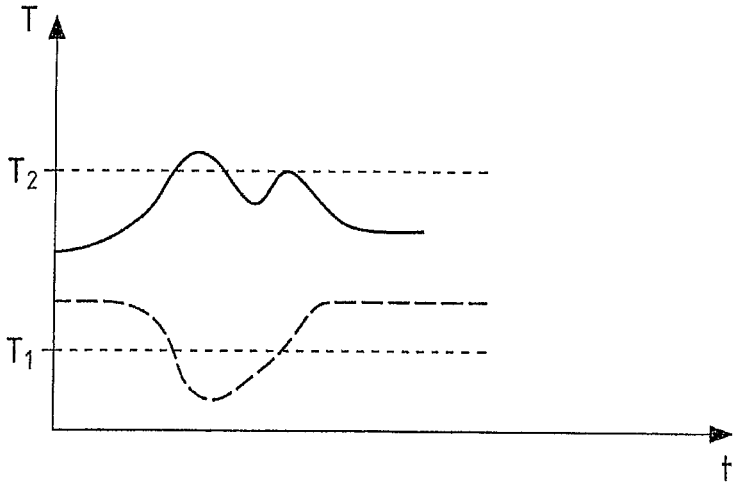

In the following using embodiments shown in a drawing the invention is explained in more detail. The drawing shows as follows:

FIG. 1 a connector piece at which a temperature profile can be measured;

FIG. 2 a perspective view of an embodiment of the device according to the invention;

FIG. 3 a front view of the device from FIG. 2;

FIG. 4 a perspective view of a further embodiment of the device according to the invention;

FIG. 5 a temperature profile during the execution of an embodiment of the method according to the invention;

FIG. 6 a further temperature profile during the execution of an embodiment of the method according to the invention.

FIG. 1 shows a connector piece 1 of a pipe system, on which using the method according to the invention a temperature profile can be indirectly measured. A clamp-on temperature sensor 2 is secured by means of a sensor mount 4 to the connector piece 1. Here the connector piece 1 is in the form of a double connector piece or a T-piece. The fluid in the pipe system flows via one of the openings 6 in the connector piece and under normal use flows through the other opening 8 out of the connector piece 1 again. If a flushing process is taking place, the fluid flows out of the third opening 10 out of the connector piece 1. Basically, however, other embodiments for measuring the temperature profile are also conceivable.

FIG. 2 now shows a perspective view of an embodiment of the device according to the invention for flushing potable water lines. The embodiment is not limited to the flushing of potable water lines, however.

On a base frame 12, a part of a first so-called water run 100 is mounted on the base frame. A magnetic valve 16, two flat sealing adapter pieces 18, 20 and a pipe section 22 are already mounted. The first water run 100 optionally also has a connector piece 1 and an optional shutoff device 14. By means of the connector piece 1 the device is for example connected to an existing pipe system, in particular a ring line.

If for a flushing process the magnetic valve 16 is opened, the water flows through the connector piece 1, through the opened shutoff device 14, which is connected by means of an adapter piece 18 to the magnetic valve 16, through the opened magnetic valve 16, which by means of a further adapter piece 20 is connected to a length of pipe 22 and through the length of pipe 22 into the outlets 24. This takes place by means of a free outflow in order not to bring about any contact between the pipe system to be flushed and the waste water system. The water then flows via two outlets 24 in the form of siphons, not shown, into the waste water system.

The device also has a power supply unit 26 and a control module 28. The control module 28 allows the measurement of the temperature profile by means of the temperature sensor 2, the evaluation of the measured data and control of the magnetic valve 16. Data from a backflow sensor system can also be processed by the control module 28.

The base frame also offers sufficient space for the implementation of a second water run 100'. This has a similar construction to the first water run 100, but can be designed differently. It is also possible to provide just one water run or more than two. The cabling of the electronic components is not shown in this drawing.

FIG. 3 shows a front view of the device from FIG. 2. Now here both water runs 100 and 100' are incorporated. The first water run 100 can for example be a cold water run, while the second water run 100 is a hot water run.

FIG. 4 shows a device similar to that from FIG. 3. For the purposes of clarity not all the references used in FIG. 2 or 3 are shown, even if corresponding elements are present. In contrast to the device from FIG. 3 only one outlet 30 with a siphon, not shown, is provided. The temperature sensors 2, 2', the magnetic valves 16, 16' and the backflow sensors, not shown, have a cabled connection with the control module 28. It is also conceivable, however, for wireless communication between the individual elements to be provided.

Further, a cover 32 is shown for covering the base frame. The cover 32 has an opening 34, via which in a simple manner access can be gained to the control module 28, even if the cover is mounted. The cover can be sealed off by a cover plate 36.

FIG. 5 shows an example of a temperature profile during the execution of an embodiment of the method according to the invention. During the time up until $t_1$ no use is made of the hot water line. For this reason the temperature does not change substantially and is below the temperature $T_2$. The temperature $T_2$ is by way of example 60° C. If the time up until $t_1$ is too long, a flushing process is triggered. Because of the hot water the temperature increases and the flushing process can be ended at time $t_3$, if the temperature threshold $T_2$ has been exceeded. In order to save water, however, the flushing process can be ended as early as time $t_2$, if only a slight change in temperature takes place and for example a temperature gradient threshold is exceeded. So there is no need to wait until a temperature threshold has been exceeded or fallen below, which may not be reached or only slowly reached.

Finally, FIG. 6 shows a further temperature profile during the execution of an embodiment of the method according to the invention. The solid curve shows the temperature profile of a hot water line. When in use the measured temperature regularly exceeds a temperature threshold $T_2$ (shown by the upper line with short dashes), which allows usage to be inferred and a scheduled flushing process to be inhibited or the restarting of a timer which measures the time when not in use in order that in the event of a correspondingly long non-usage a flushing process is triggered.

Similarly, the curve with the long dashes shows the temperature profile of a cold water line. Here usage accordingly results in a falling below a temperature threshold $T_1$ (shown by the lower line with short dashes) and as a result a scheduled flushing process can for example be inhibited or a timer can be restarted.

The invention claimed is:

1. A method for automatic flushing of at least one fluid line, wherein the at least one fluid line is a cold potable water line or a hot potable water line, in which a temperature profile of the fluid in the at least one fluid line is directly or indirectly measured;

in which data generated from the measurement of the temperature profile is evaluated by determining whether, over a specified length of time, the temperature of the fluid in the at least one fluid line is constant or varies; and in which a flushing process of the at least one fluid line is influenced by an outcome of the evaluation.

2. The method according to claim 1, wherein the flushing process is triggered, ended, not triggered, inhibited and/or continued by the outcome of the evaluation.

3. The method according to claim 1 further comprising continuing the flushing process until a temperature threshold and/or a temperature gradient threshold is exceeded or fallen below.

4. The method according to claim 1 further comprising continuing the flushing process until a constant temperature is measured for a specified length of time.

5. The method according to claim 1, wherein the flushing process is triggered if a constant temperature is measured for the specified length of time.

6. The method according to claim 1, wherein the flushing process is triggered if for the specified length of time an insufficiently fast change in temperature is measured.

7. The method according to claim 1, wherein the flushing process is inhibited if for the specified length of time a sufficiently fast change in temperature is measured.

8. The method according to claim 1, wherein the temperature is measured by means of a temperature sensor on the at least one fluid line.

9. The method according to claim 1, wherein the temperature is measured at a T-piece of the at least one fluid line.

10. The method according to claim 1, wherein the flushing process is inhibited if a varying temperature is measured for the specified length of time.

11. A device for automatic flushing of fluid lines for performing the method according to claim 1, comprising:

means for measuring the temperature;

means for capturing, storing, and evaluating the temperatures measured; and means for performing a flushing process are provided.

12. The device according to claim 11, wherein a temperature sensor is provided on at least one fluid line.

13. The device according to claim 11, wherein means for measuring the temperature are provided at a T-piece or a U-piece.

14. The method according to claim 1, wherein the at least one fluid line is a potable water line.

15. The device according to claim 11, wherein the fluid lines are potable water lines.

16. The device according to claim 11, wherein means for measuring the temperature are provided as a separate component for flexible positioning on the fluid lines.

* * * * *